US005392677A

United States Patent [19]

Sevart et al.

[11] Patent Number: 5,392,677

[45] Date of Patent: Feb. 28, 1995

[54] ROOFING SHINGLE ANGLE CUTTER

[76] Inventors: John D. Sevart; Thelma L. Sevart, both of Rte. 6, Box 197, Rolla, Mo. 65401

[21] Appl. No.: 85,908

[22] Filed: Jul. 6, 1993

[51] Int. Cl.[6] ..... B26D 5/12; B26D 5/14

[52] U.S. Cl. ..... 83/468.3; 83/634; 83/635; 83/639.1; 83/662; 83/697

[58] Field of Search ..... 83/468, 468.3, 563, 83/581, 613, 630, 634, 635, 639.1, 662, 694, 697, 636

[56] References Cited

U.S. PATENT DOCUMENTS

| | | | |
|---|---|---|---|
| 1,524,823 | 2/1925 | Henesey | 83/630 X |
| 1,918,104 | 7/1933 | Hook | 83/694 X |
| 2,532,672 | 12/1950 | Michael et al. | 83/630 X |
| 3,199,395 | 8/1965 | Savory | 83/635 X |
| 3,467,154 | 9/1969 | Girard | 143/115 |
| 4,510,834 | 4/1985 | Greene et al. | 83/453 |
| 4,821,609 | 4/1989 | Rushbrook et al. | 81/45 |
| 4,951,540 | 8/1990 | Cross et al. | 83/397 |
| 5,052,256 | 10/1991 | Morrissey | 83/468 |
| 5,249,495 | 10/1993 | Renk | 83/468.3 |

*Primary Examiner*—Richard K. Seidel

*Assistant Examiner*—Raymond D. Woods

*Attorney, Agent, or Firm*—David L. Baker; Robert A. Shack

[57] ABSTRACT

A shingle cutting tool for cutting a shingle having a longitudinal edge, the shingle cutting tool making a cut across the shingle at a selectable angle transverse to the longitudinal edge thereof, the shingle cutting tool including a guide member, the guide member having a substantially upright surface for guiding the longitudinal edge of the shingle, and a cutting assembly, the cutting assembly being pivotally attached to the guide member and extending outward therefrom, the cutting assembly including a cutting base member, a cutting blade, the cutting blade having a cutting edge, the cutting edge opposing the base member, a reciprocating guide mechanism for guiding the cutting blade in a reciprocating fashion within a plane extending from the cutting base, and a pressure mechanism for exerting a pressure on the cutting blade to thereby bring the cutting edge into contact with the cutting base member. Alternatively, the pressure mechanism includes either a manually actuated lever mechanism or a pneumatic cylinder.

11 Claims, 2 Drawing Sheets

ROOFING SHINGLE ANGLE CUTTER

BACKGROUND

1. Field of the Invention

The present invention relates to the field of roofing shingle cutters and/or trimmers.

Often the job of shingling a roof, or other structure for that matter, requires that the shingles have one or more portions thereof cut to various angles. This is particularly true when trying to fit shingles around architectural details, such as chimneys, dormers, etc. The invention disclosed herein is directed to accomplishing this task more quickly and accurately than the methods used heretofore.

2. Description of the Related Art

U.S. Pat. No. 4,951,540 relates to a shingle ridge cap cutter that includes a frame over which a shingle is guided to a cutter having a pair of nonparallel cutter blades.

U.S. Pat. No. 5,052,256 relates to a shingle cutting apparatus that includes a case, a lever arm pivotally mounted to the base, and a pair of diverging cutting blades mounted to the lever arm. A pair of grooves are defined in the base corresponding to the positions of the cutting blades.

U.S. Pat. No. 4,510,834 relates to a cutter having a pivoted support for cutting a piece of vinyl or aluminum siding.

U.S. Pat. No. 4,821,609 relates to a shingle cutting tool for removing the tab portions from shingles on an existing roof so as to reduce the dead load on the roofing structure before the installation of new shingles thereover.

U.S. Pat. No. 3,467,154 relates to a shingle cutting machine having a block supporting carriage mounted for reciprocation past a saw blade.

SUMMARY OF THE INVENTION

In one aspect, the invention generally features a shingle cutting tool for cutting a shingle having a longitudinal edge, the shingle cutting tool making a cut across the shingle at a selectable angle transverse to the longitudinal edge thereof, the shingle cutting tool including: a guide member, the guide member having a substantially upright surface for guiding the longitudinal edge of the shingle; and a cutting assembly; the cutting assembly being pivotally attached to the guide member and extending outward therefrom; the cutting assembly including: a cutting base member; a cutting blade, the cutting blade having a cutting edge, the cutting edge opposing the base member; a reciprocating guide mechanism for guiding the cutting blade in a reciprocating fashion within a plane extending from the cutting base; and a pressure mechanism for exerting a pressure on the cutting blade to thereby bring the cutting edge into contact with the cutting base member.

Preferably, the pressure mechanism includes a manual pressure mechanism for the application of a manual pressure supplied by a user of the shingle cutting tool; the manual pressure mechanism includes at least a pair of lever arms, one of the pair of lever arms being connected to the cutting base member and the other of the pair of lever arms being connected to the cutting blade; the reciprocating guide mechanism includes at least one pin extending outward from the cutting base member and at least one slot provided in the cutting blade, the at least one pin being disposed within the at least one slot; the reciprocating guide mechanism includes a pin positioned at each end of the cutting base member and a slot positioned at each end of the cutting blade, one each of the pins being disposed within one each of the slots; the shingle cutting tool additionally includes a retaining mechanism for retaining the cutting assembly at a selected transverse angle with respect to the guide member; the retaining mechanism includes a wing nut; the shingle cutting tool additionally includes a plurality of graduated measurement marks extending along the longitudinal axis of the guide member; the pressure mechanism includes a pneumatically actuated piston and cylinder.

In another aspect, the invention generally features a shingle cutting tool for cutting a shingle having a longitudinal edge, the shingle cutting tool making a cut across the shingle at a selectable angle transverse to the longitudinal edge thereof, the shingle cutting tool including: a guide member, the guide member having a substantially upright surface for guiding the longitudinal edge of the shingle; and a cutting assembly; the cutting assembly being pivotally attached to the guide member and extending outward therefrom; the cutting assembly including: a cutting base member; a cutting blade, the cutting blade having a cutting edge, the cutting edge opposing the base member; a reciprocating guide mechanism for guiding the cutting blade in a reciprocating fashion within a plane extending from the cutting base; and a manual pressure mechanism for manually exerting a pressure on the cutting blade to thereby bring the cutting edge into contact with the cutting base member; wherein the manual pressure mechanism includes at least a pair of lever arms, one of the pair of lever arms being connected to the cutting base member and the other of the pair of lever arms being connected to the cutting blade; wherein the reciprocating guide mechanism includes a pin positioned at each end of the cutting base member and a slot positioned at each end of the cutting blade, one each of the pins being disposed within one each of the slots; and wherein the shingle cutting tool additionally includes a retaining mechanism for retaining the cutting assembly at a selected transverse angle with respect to the guide member.

In yet another aspect, the invention generally features a shingle cutting tool for cutting a shingle having a longitudinal edge, the shingle cutting tool making a cut across the shingle at a selectable angle transverse to the longitudinal edge thereof, the shingle cutting tool including: a guide member, the guide member having a substantially upright surface for guiding the longitudinal edge of the shingle; and a cutting assembly; the cutting assembly being pivotally attached to the guide member and extending outward therefrom; the cutting assembly including: a cutting base member; a cutting blade, the cutting blade having a cutting edge, the cutting edge opposing the base member; a reciprocating guide mechanism for guiding the cutting blade in a reciprocating fashion within a plane extending from the cutting base; and a pressure mechanism for exerting a pressure on the cutting blade to thereby bring the cutting edge into contact with the cutting base member; wherein the pressure mechanism includes a pneumatic cylinder; wherein the reciprocating guide mechanism includes a pin positioned at each end of the cutting base member and a slot positioned at each end of the cutting blade, one each of the pins being disposed within one each of the slots; wherein the shingle cutting tool additionally includes a retaining mechanism for retaining the cutting assembly at a selected transverse angle with respect to the guide member; wherein the retaining mechanism includes a wing nut; and wherein the shingle cutting tool additionally includes a plurality of graduated measurement marks extending along the longitudinal axis of the guide member.

One object of the present invention is the provision of a tool that permits the easy cutting of one end of a shingle to any selected angle transverse to the longitudinal axis of the shingle.

Another object of the invention is the provision of such a tool that is simple in both operation and construction and that is, therefore inexpensive to manufacture.

The invention will now be described by way of a particularly preferred embodiment, reference being made to the accompanying drawings, wherein:

DESCRIPTION OF THE PREFERRED EMBODIMENT

Figure 1:
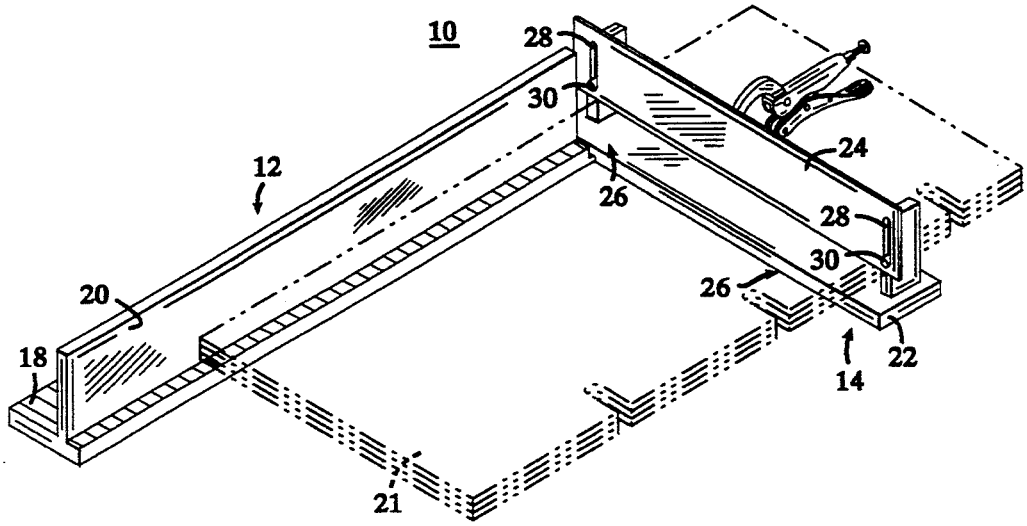
FIG. 1 is a perspective view of a shingle cutting tool constructed according to the present invention.
Figure 2:
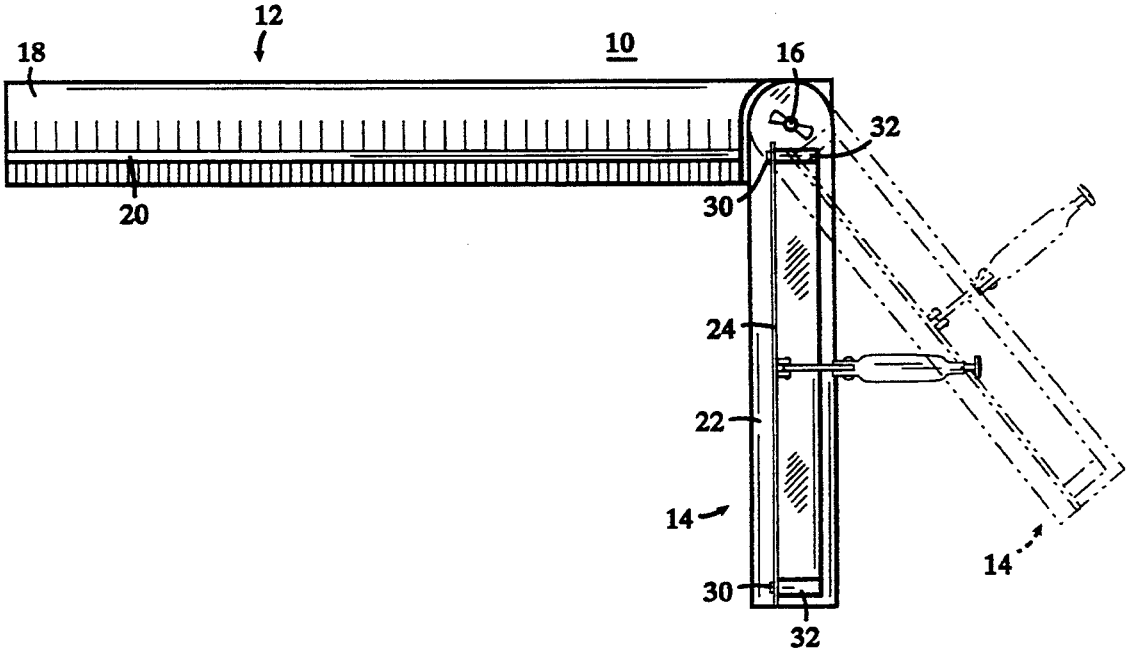
FIG. 2 is a top plan view of the inventive shingle cutting tool of FIG. 1.

Referring initially to FIGS. 1 and 2, a shingle cutting tool 10 constructed according to the invention generally includes a guide member 12 and a cutting assembly 14. The cutting assembly 14 is pivotally connected to the guide member 12 by a bolt and wing nut assembly 16 and extends outward therefrom, the pivotal connection allowing the adjustment of the cutting assembly 14 at various transverse angles with respect to the guide member 12, as is illustrated in FIG. 2.

The guide member 12 itself includes a base member 18 and an upstanding flange 20 that extends substantially vertically upward from the base member 18. A shingle (or a stack of shingles) 21 that are to be cut to a desired angle are placed, as shown in FIGS. 1, 3, and 4, so that the longitudinal edge thereof abuts the upstanding flange 20 and such that the excess shingle material that is to be removed extends through the cutting assembly 14.

The cutting assembly 14 itself generally includes a cutting base member 22 and a cutting blade 24 opposed thereto. A reciprocating guide mechanism 26 provides for a reciprocating movement of the cutting blade 24 within a plane extending from the cutting base 22. Preferably, the reciprocating guide mechanism 26 includes a pair of substantially vertical slots 28 provided on the cutting blade 24 and a pair of substantially horizontally oriented pins 30 extending from the cutting base 22.

Figure 3:
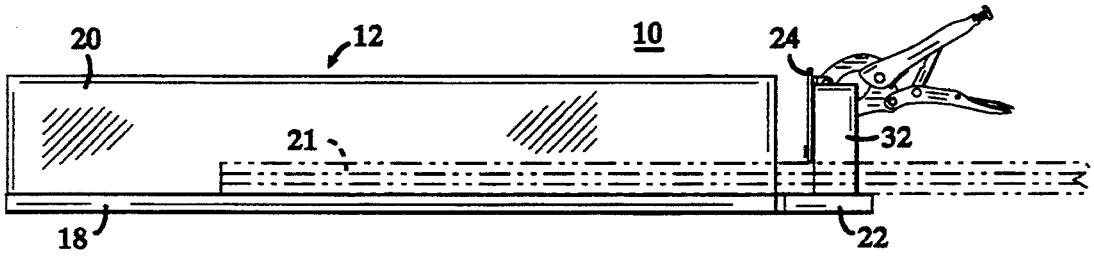
FIG. 3 is a side elevational view of the inventive shingle cutting tool.
Figure 4:
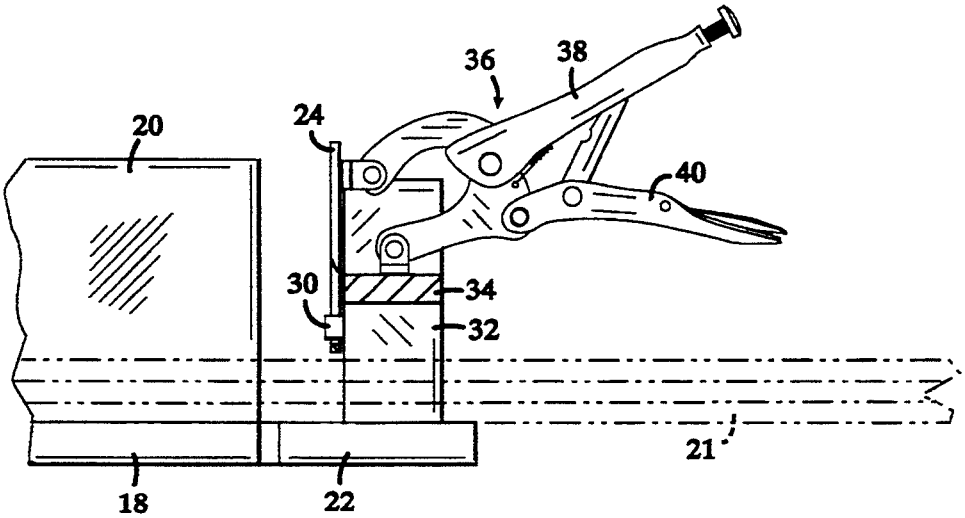
FIG. 4 is a partial sectional side view of the inventive shingle cutting tool, along the lines shown in FIG. 5.
Figure 5:
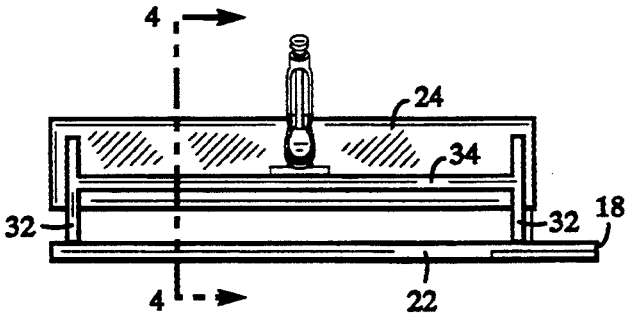
FIG. 5 is an end elevational view of the inventive shingle cutting tool.

Referring most particularly now to FIGS. 3—5, the cutting base 22 additionally includes a pair of upright stanchions 32 and a substantially horizontal crosspiece 34 extending therebetween, with the pins 30 extending outward from the stanchions 32. A manually actuable pressure mechanism 36, which preferably includes a pair of levers 38 and 40, and which even more preferably includes a lever mechanism offering a high degree of mechanical advantage is interconnected between the crosspiece 34 and the cutting blade 24, such that squeezing the levers 38 and 40 will force the cutting blade 24 down through the shingle(s) 21 and into contact with the cutting base member 22, thereby severing the shingle(s) 21 at the angle relative to the guide member 12 that the cutting mechanism 14 has been set.

Figure 4A:
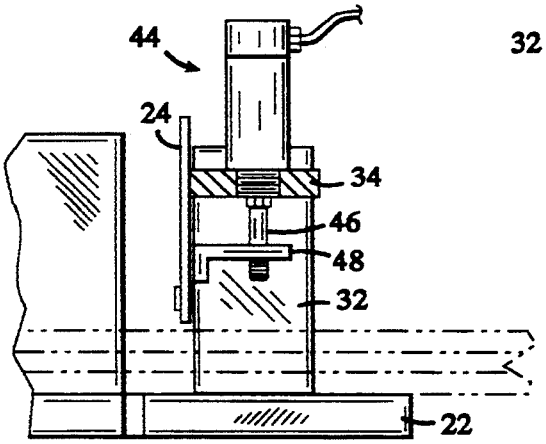
FIG. 4(A) is a partial sectional side view of an alternative embodiment of the shingle cutting tool according to the invention.

An alternative embodiment of the invention that employs air pressure to force the cutting bar through the shingle(s) is shown in FIG. 4(A). There, a pneumatic cylinder 44 having a downward projecting piston rod 46 is mounted on the crosspiece 34, the piston rod 46 being connected to the cutting blade 24 via a horizontal flange 48 extending therefrom. Pressurizing the pneumatic cylinder 46 forces the cutting blade 24 downward.

While the invention has been herein described by way of a particular preferred embodiment, various substitutions of equivalents may be effected without departing from the spirit and scope of the invention as set forth in the following claims.

What is claimed is:

1. A shingle cutting tool for cutting a shingle having a longitudinal edge, said shingle cutting tool making a cut across the shingle at a selectable angle transverse to the longitudinal edge thereof, said shingle cutting tool comprising:

a guide member, said guide member having a substantially upright surface for guiding the longitudinal edge of the shingle; and a cutting assembly;

said cutting assembly being pivotally attached to said guide member and extending outward therefrom;

said cutting assembly comprising:

a cutting base member;

a cutting blade, said cutting blade having a cutting edge, said cutting edge opposing said base member;

a reciprocating guide means for guiding said cutting blade in a reciprocating fashion within a plane extending from a cutting base;

a pressure means for exerting a pressure on said cutting blade to thereby bring said cutting edge into contact with said cutting base member; and a cutting stroke adjustment member attached to the pressure means and to the cutting blade.

2. A shingle cutting tool according to claim 1, wherein said pressure means comprises manual pressure means for an application of a manual pressure supplied by a user of said shingle cutting tool.

3. A shingle cutting tool according to claim 2, wherein said manual pressure means comprises at least a pair of lever arms, one of said pair of lever arms being connected to said cutting base member and the other of said pair of lever arms being connected to said cutting blade.

4. A shingle cutting tool according to claim 3, wherein said reciprocating guide means comprises at least one pin extending outward from said cutting base member and at least one slot provided in said cutting blade, said at least one pin being disposed within said at least one slot.

5. A shingle cutting tool according to claim 4, wherein said at least one pin and said at least one slot comprises a pin positioned at each end of said cutting base member and a slot positioned at each end of said cutting blade, one each of said pins being disposed within one each of said slots.

6. A shingle cutting tool according to claim 5, wherein said shingle cutting tool additionally comprises retaining means for retaining said cutting assembly at a selected transverse angle with respect to said guide member.

7. A shingle cutting tool according to claim 6, wherein said retaining means comprises a wing nut.

8. A shingle cutting tool according to claim 7, wherein said shingle cutting tool additionally comprises a plurality of graduated measurement marks extending along a longitudinal axis of said guide member.

9. A shingle cutting tool according to claim 1, wherein said pressure means comprises a pneumatically actuated piston and cylinder.

10. A shingle cutting tool for cutting a shingle having a longitudinal edge, said shingle cutting tool making a cut across the shingle at a selectable angle transverse to the longitudinal edge thereof, said shingle cutting tool comprising:

a guide member, said guide member having a substantially upright surface for guiding the longitudinal edge of the shingle; and a cutting assembly;

said cutting assembly being pivotally attached to said guide member and extending outward therefrom;

said cutting assembly comprising:

a cutting base member;

a cutting blade, said cutting blade having a cutting edge, said cutting edge opposing said base member;

a reciprocating guide means for guiding said cutting blade in a reciprocating fashion within a plane extending from a cutting base; and a manual pressure means for manually exerting a pressure on said cutting blade to thereby bring said cutting edge into contact with said cutting base member;

a cutting stroke adjustment member attached to the pressure means and to the cutting blade;

said manual pressure means comprises at least a pair of lever arms, one of said pair of lever arms being connected to said cutting base member and the other of said pair of lever arms being connected to said cutting blade;

said reciprocating guide means comprises a pin positioned at each end of said cutting base member and a slot positioned at each end of said cutting blade, one each of said pins being disposed within one each of said slots; and said shingle cutting tool additionally comprises retaining means for retaining said cutting assembly at a selected transverse angle with respect to said guide member.

11. A shingle cutting tool for cutting a shingle having a longitudinal edge, said shingle cutting tool making a cut across the shingle at a selectable angle transverse to the longitudinal edge thereof, said shingle cutting tool comprising:

a guide member, said guide member having a substantially upright surface for guiding the longitudinal edge of the shingle; and a cutting assembly;

said cutting assembly being pivotally attached to said guide member and extending outward therefrom;

said cutting assembly comprising:

a cutting base member;

a cutting blade, said cutting blade having a cutting edge, said cutting edge opposing said base member;

a reciprocating guide means for guiding said cutting blade in a reciprocating fashion within a plane extending from a cutting base; and a pressure means for exerting a pressure on said cutting blade to thereby bring said cutting edge into contact with said cutting base member;

a cutting stroke adjustment member attached to the pressure means and to the cutting blade;

said pressure means comprises a pneumatic cylinder;

said reciprocating guide means comprises a pin positioned at each end of said cutting base member and a slot positioned at each end of said cutting blade, one each of said pins being disposed within one each of said slots;

said shingle cutting tool additionally comprises retaining means for retaining said cutting assembly at a selected transverse angle with respect to said guide member;

said retaining means comprises a wing nut; and said shingle cutting tool additionally comprises a plurality of graduated measurement marks extending along a longitudinal axis of said guide member.

* * * * *